US006858360B2

(12) United States Patent
Parsapour

(10) Patent No.: US 6,858,360 B2
(45) Date of Patent: Feb. 22, 2005

(54) COMPOSITION AND METHOD FOR ADHESION OF COLOR FILTERS TO A FACEPLATE PANEL OF A CATHODE RAY TUBE (CRT)

(75) Inventor: Farzad Parsapour, Reading, PA (US)

(73) Assignee: Thomson Licensing S. A., Boulogne-Billancourt (FR)

( * ) Notice: Subject to any disclaimer, the term of this patent is extended or adjusted under 35 U.S.C. 154(b) by 64 days.

(21) Appl. No.: 10/153,752

(22) Filed: May 22, 2002

(65) Prior Publication Data

US 2003/0219657 A1 Nov. 27, 2003

(51) Int. Cl.[7] ..... G03C 5/00
(52) U.S. Cl. ..... 430/27; 427/68
(58) Field of Search ..... 430/27; 427/68; 313/112, 466

(56) References Cited

U.S. PATENT DOCUMENTS 5,340,673 A 8/1994 Tateyama et al. ..... 430/23
6,071,657 A * 6/2000 Kusunoki et al. ..... 430/28
6,093,349 A 7/2000 Ihara et al. ..... 252/584
6,642,647 B2 * 11/2003 Taniguchi et al. ..... 313/477 R

OTHER PUBLICATIONS

Patent Abstract of Japan; Pub. No. 11233018; Pub. Date: Aug. 27, 1999; Applicant: Toshiba Corp; Inventor: Koike Norio; Title: Forming Method for Fluorescent Screen with Filter for Color Cathode–Ray Tube.

* cited by examiner

*Primary Examiner*—John A. McPherson
(74) *Attorney, Agent, or Firm*—Joseph S. Tripoli; Harvey D. Fried; Richard LaPeruta, Jr.

(57) ABSTRACT

A method and composition for manufacturing a luminescent screen assembly for a color cathode ray tube (CRT) is disclosed. The luminescent screen assembly is formed on an interior surface of a faceplate panel of the CRT. The luminescent screen assembly has a patterned light-absorbing matrix thereon. The matrix defines a first set of fields, a second set of fields, and a third set of fields. An aqueous pigment suspension is applied to the first set of fields. The aqueous pigment suspension comprises a pigment, one or more surface-active agents and at least one non-pigmented oxide particle. The at least one non-pigmented oxide particle has a size that is less than that of the pigment.

8 Claims, 5 Drawing Sheets

COMPOSITION AND METHOD FOR ADHESION OF COLOR FILTERS TO A FACEPLATE PANEL OF A CATHODE RAY TUBE (CRT)

BACKGROUND OF THE INVENTION

1. Field of the Invention

This invention relates to a color cathode ray tube (CRT) and, more particularly, to the manufacturing of a luminescent screen assembly using a filter composition comprising a pigment and non-pigmented oxide particles.

2. Description of the Background Art

A color cathode ray tube (CRT) typically includes an electron gun an aperture mask, and a screen. The aperture mask is interposed between the electron gun and the screen. The screen is located on an inner surface of a faceplate of the CRT tube. The aperture mask functions to direct electron beams generated in the electron gun toward appropriate color-emitting phosphors on the screen of the CRT tube.

The screen may be a luminescent screen. Luminescent screens typically comprise an array of three different color-emitting phosphors (e.g., green, blue and red) formed thereon. Each of the color-emitting phosphors is separated from another by a matrix line. The matrix lines are typically formed of a light absorbing black, inert material.

In order to enhance the color contrast of the luminescent screen, a pigment layer, or color filter may be formed between the faceplate panel and the color-emitting phosphor. The color filter typically has a color that corresponds to the color of the color-emitting phosphor formed thereon.

The color filters are typically formed using a subtractive process in which the filter layer is deposited on the luminescent screen, and, in a subsequent development process, select portions of the filter layer are removed. Unfortunately, during the development process void formation within the color filter may occur. Void formation is typically caused by a failure of portions of the color filter to adhere properly to the faceplate panel during the development process. Voids resulting from such an adhesion failure may result in lower color contrast for the luminescent screen.

Thus, a need exists for a color filter composition that overcomes the above-mentioned drawbacks.

SUMMARY OF THE INVENTION

The present invention relates to a composition and method for adhesion of color filters on a luminescent screen assembly of a cathode ray tube (CRT). The luminescent screen assembly is formed on an interior surface of a faceplate panel of the CRT tube. The luminescent screen assembly includes a patterned light-absorbing matrix that defines a first set of fields, a second set of fields and a third set of fields corresponding to one of a blue region, a green region and a red region.

An aqueous pigment suspension is applied to the first set of fields. The aqueous pigment suspension comprises a pigment, one or more surface active agents and at least one non-pigmented oxide particle. The at least one non-pigmented oxide particle has a size that is less than that of the pigment. The at least one non-pigmented oxide particle improves the adhesion of the pigment to the faceplate panel. As a result, the color filter is less susceptible to void formation.

BRIEF DESCRIPTION OF THE DRAWINGS

The invention will now be described in greater detail, with relation to the accompanying drawings, in which.

DETAILED DESCRIPTION OF THE INVENTION

Figure 1:
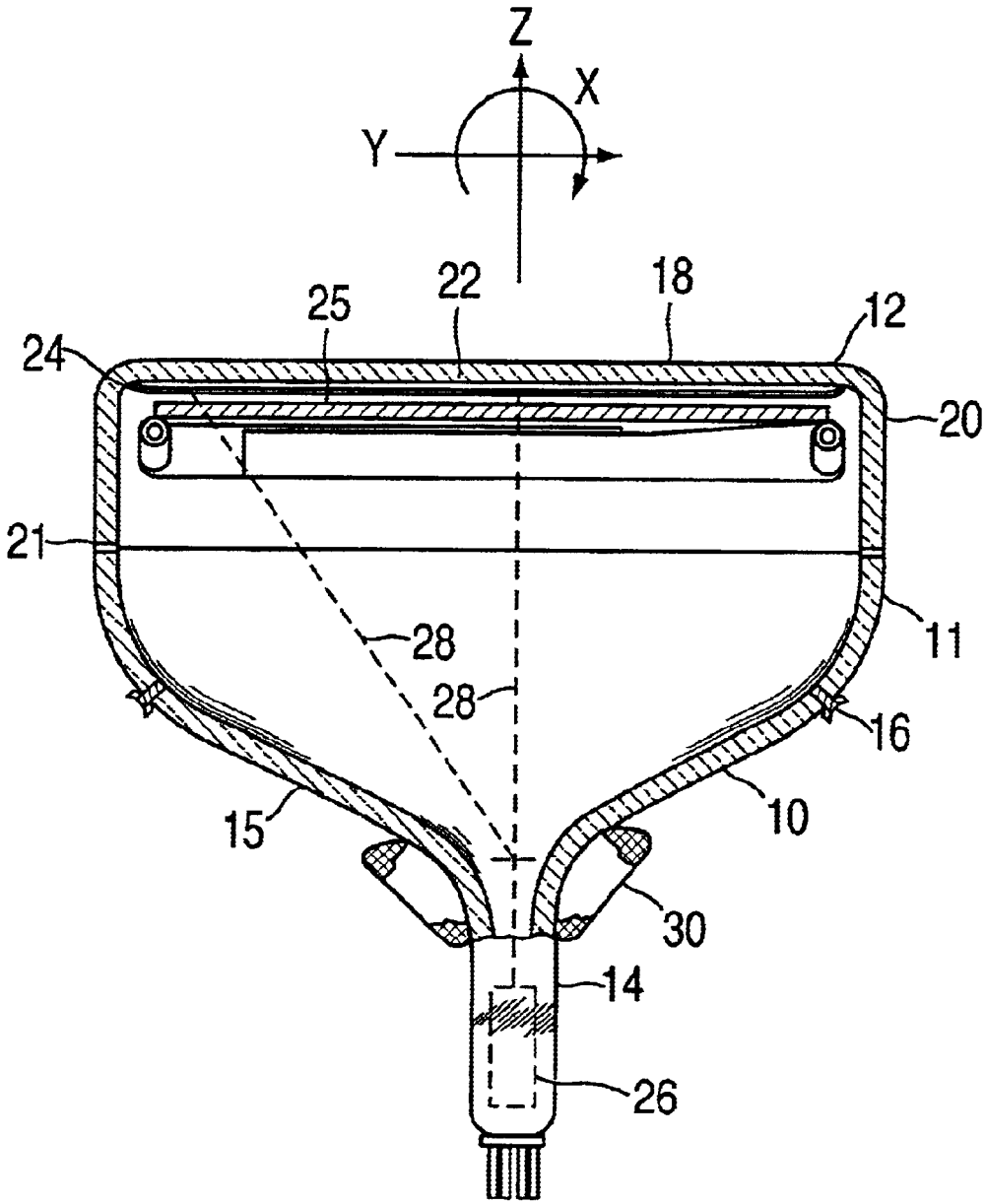
FIG. 1 is plan view, partly in axial section, of a color cathode ray tube (CRT) made according to embodiments of the present invention.

FIG. 1 shows a conventional color cathode ray tube (CRT) 10 having a glass envelope 11 comprising a faceplate panel 12 and a tubular neck 14 connected by a funnel 15. The funnel 15 has an internal conductive coating (not shown) that is in contact with, and extends from, an anode button 16 to the neck 14.

Figure 2:
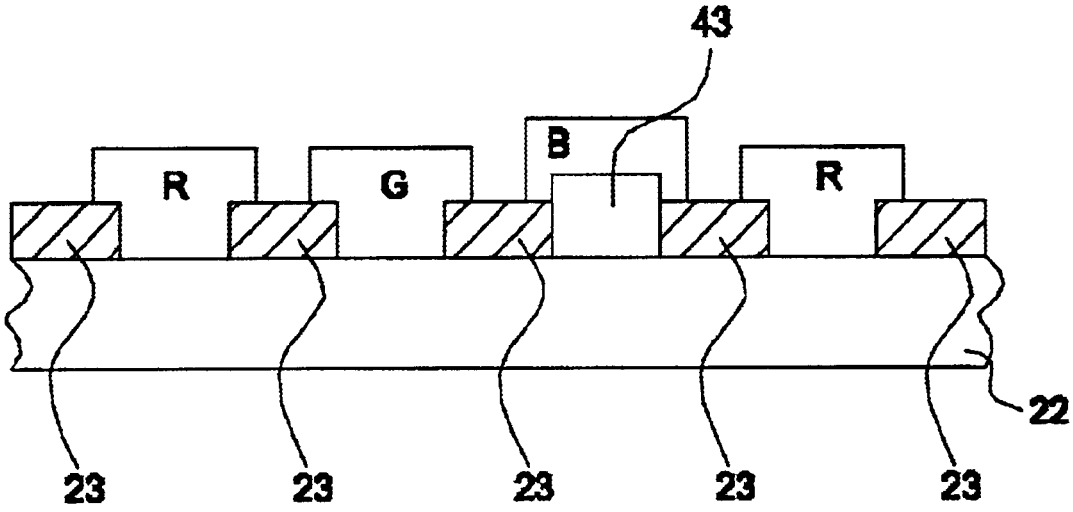
FIG. 2 is a section of the faceplate panel of the CRT of FIG. 1, showing a luminescent screen assembly.

The faceplate panel 12 comprises a viewing surface 18 and a peripheral flange or sidewall 20 that is sealed to the funnel 15 by a glass frit 21. A three-color luminescent phosphor screen 22 is carded on the inner surface of the faceplate panel 12. The screen 22, shown in cross-section in FIG. 2, is a line screen which includes a multiplicity of screen elements comprised of red-emitting, green-emitting, and blue-emitting phosphor stripes R, G, and B, respectively, arranged in triads, each triad including a phosphor line of each of the three colors. The R, G, B, phosphor stripes extend in a direction that is generally normal to the plane in which the electron beams are generated. The B phosphor stripes are formed on a color filter 43. The color filter 43 comprises a pigment that corresponds to the color of the phosphor stripe formed thereon.

A light-absorbing matrix 23, shown in FIG. 2, separates each of the phosphor lines. A thin conductive layer 24, preferably of aluminum, overlies the screen 22 and provides means for applying a uniform first anode potential to the screen 22, as well as for reflecting light, emitted from the phosphor elements, through the viewing surface 18. The screen 22 and the overlying aluminum layer 24 comprise a screen assembly.

A multi-aperture color selection electrode, or shadow mask 25 (shown in FIG. 1), is removably mounted, by conventional means, within the faceplate panel 12, in a predetermined spaced relation to the screen 22.

An electron gun 26, shown schematically by the dashed lines in FIG. 1, is centrally mounted within the neck 14, to generate three inline electron beams 28, a center and two side or outer beams, along convergent paths through the shadow mask 25 to the screen 22. The inline direction of the beams 28 is approximately normal to the plane of the paper.

The CRT of FIG. 1 is designed to be used with an external magnetic deflection yoke, such as a yoke 30, shown in the neighborhood of the funnel-to-neck junction. When activated, the yoke 30 subjects the three beams 28 to magnetic fields that cause the beams to scan a horizontal and vertical rectangular raster across the screen 22.

Figure 3:
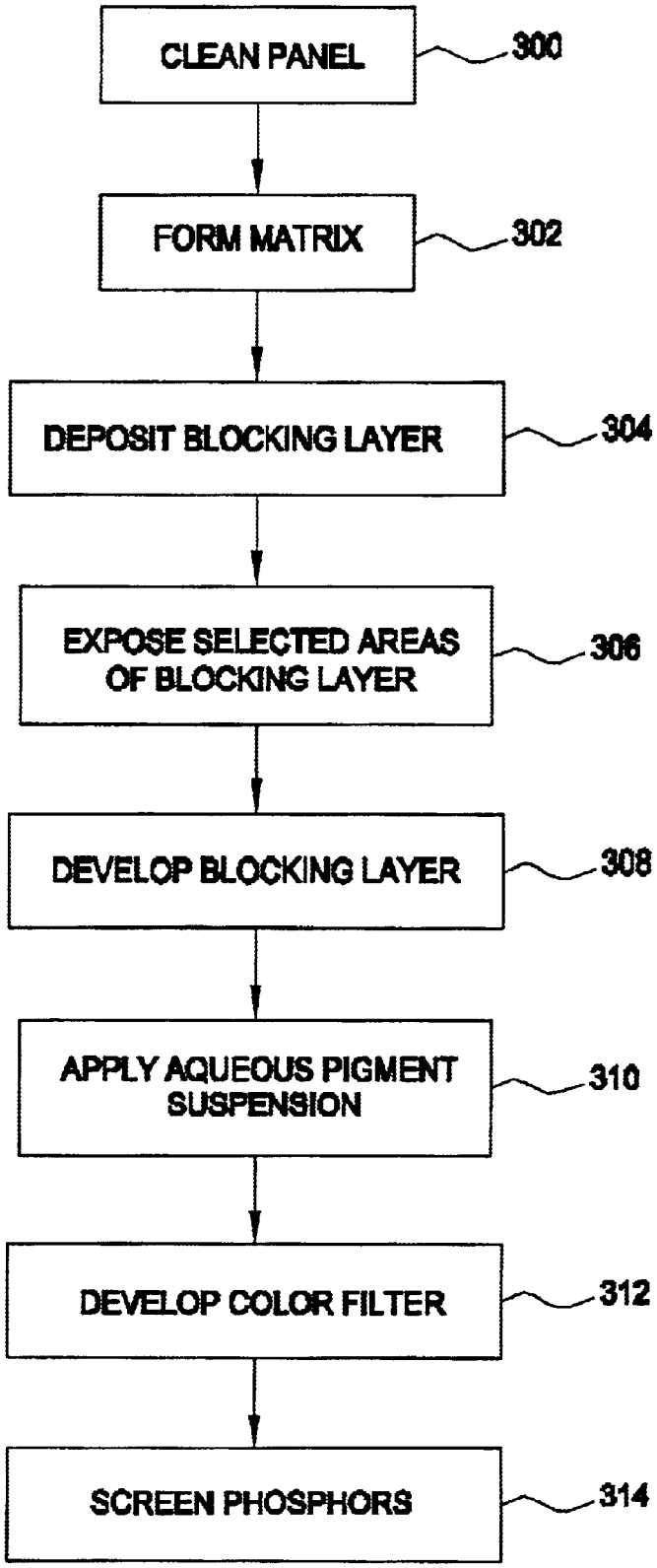
FIG. 3 is a block diagram comprising a flow chart of the manufacturing process for the screen assembly of FIG. 2.

The screen 22 is manufactured according to the process steps represented schematically in FIG. 3. Initially, the faceplate panel 12 is cleaned, as indicated by reference numeral 300, by washing it with a caustic solution, rinsing it in water, etching it with buffered hydrofluoric acid and rinsing it again with water, as is known in the art.

The interior surface of the faceplate panel 12 is then provided with the light-absorbing matrix 23, as indicated by reference numeral 302, preferably, using a wet matrix process in a manner described in U.S. Pat. Nos. 3,558,310, issued Jan. 26, 1971 to Mayaud, 6,013,400 issued Jan. 11, 2000 to LaPeruta et al., or 6,037,086 issued Mar. 14, 2000 to Gorog et al.

Figure 4A:
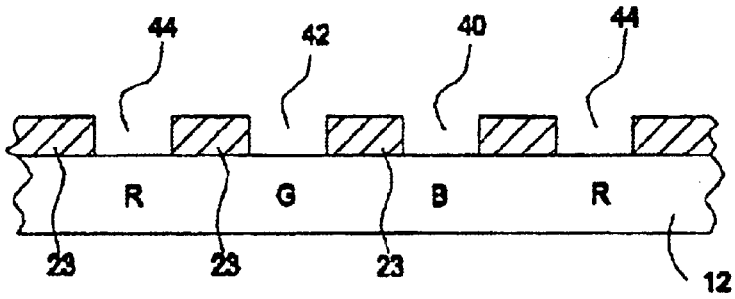
FIG. 4 depicts views of the interior surface of the faceplate panel luminescent screen assembly during color filter formation.

The light-absorbing matrix 23 is uniformly provided over the interior viewing surface of faceplate panel 12. For a faceplate panel 12 having a diagonal dimension of about 68 cm (27 inches), the openings formed in the layer of light-absorbing matrix 23 can have a width in a range of about 0.075 mm to about 0.25 mm, and the opaque matrix lines can have a width in a range of about 0.075 mm to about 0.30 mm. Referring to FIG. 4A, the light-absorbing matrix 23 defines three sets of fields: a first set of fields 40, a second set of fields 42, and a third set of fields 44.

Figure 4B:
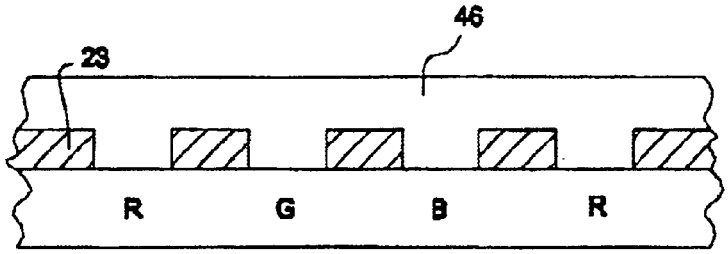

As indicated by reference numeral 304 in FIG. 3, as well as FIG. 4B, a blocking layer 46 is deposited on the interior surface of the faceplate panel 12. A suitable blocking layer 46 may comprise a photosensitive material. The photosensitive material may comprise, for example, an aqueous solution of sodium dichromate and a polymer such as polyvinyl alcohol. The blocking layer 46 may be formed on the faceplate panel 12 by spin coating the aqueous solution of the polymer and dichromate thereon.

Referring to reference numeral 306 in FIG. 3, the blocking layer 46 is irradiated using, for example, ultraviolet radiation, through the shadow mask 25 to cross-link the photosensitive material in the second set of fields 42 and the third set of fields 44. The cross-linking the blocking layer 46 in the second set of fields 42 and the third set of fields 44 hardens the photosensitive material in such fields.

Figure 4C:
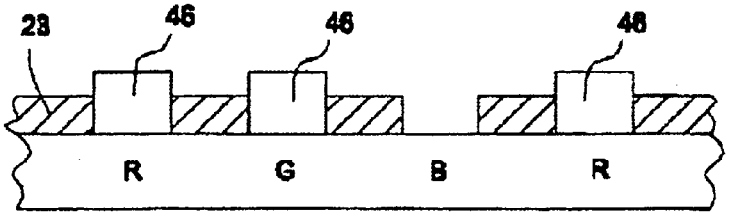

The irradiated blocking layer 46 is then developed as indicated by reference numeral 308 in FIG. 3, as well as FIG. 4C. The blocking layer 46 may be developed using, for example, deionized water. After development, the blocking layer 46 is removed over the first set of fields 40, while remaining on the faceplate panel 12 over the second set of fields 42 and the third set of fields 44.

Figure 4D:
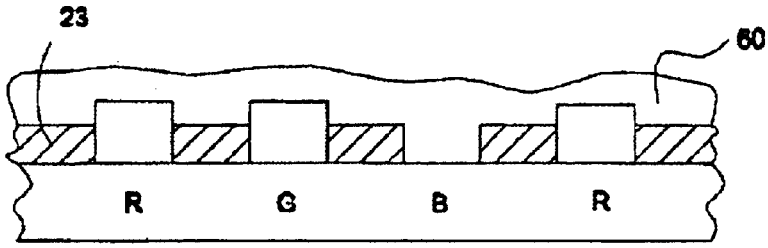

Referring to reference numeral 310 in FIG. 3 as well as FIG. 4D, pigment is applied to the first set of fields 40. The pigment may be applied from an aqueous pigment suspension that may comprise pigment, one or more surface active agents and at least one non-pigmented oxide particle.

The at least one non-pigmented oxide particle may comprise a material, such as, for example, silica, alumina, or combinations thereof. The at least one non-pigmented oxide particle should have a size less than that of the pigment. Preferably the average size of the at least one non-pigmented oxide particle should be less than about 50 nanometers. The at least one non-pigmented oxide particle is believed to enhance the adhesion of the pigment to the faceplate panel. The at least one non-pigmented oxide particle may be present in a concentration of about 5% to about 10% by weight with respect to the concentration of the pigment.

The pigment may be, for example, a blue pigment, such as daipyroxide blue pigment TM-3490E, commercially available from Daicolor-Pope, Inc. of Paterson, N.J. Another suitable pigment may include for example, EX1041 blue pigment, commercially available from Shepherd Color Co. of Cincinnati, Ohio, among other pigments.

The pigment may be milled using a ball milling process in which the pigment is dispersed along with one or more surfactants in an aqueous suspension. The pigment may be ball milled using for example, 1/16" $ZrO_2$ balls for at least about 61 hours up to about 90 hours. Preferably, the pigment may be ball milled for about 66 hours.

The one or more surface active agents may include, for example organic and polymeric compounds that may optionally adopt an electric charge in aqueous solution. The surface active agent may comprise, anionic, non-ionic, cationic, and/or amphoteric materials. The surface-active agent may be used for various functions such as improving the homogeneity of the pigment in the aqueous pigment suspension, stabilization of nanoparticles, improved wetting of the faceplate panel, among other functions. Examples of suitable surface-active agents include various polymeric dispersants such as, for example, DISPEX N-40V polymeric dispersant (commercially available from Ciba Specialty Chemicals of High Point, N.C.) as well as block copolymer surface active agents such as Pluronic Series (ethoxypropoxy co-polymers) L-62, commercially available from BASF Corp. of Germany, DAXAD 15 or 19, commercially available from Hampshire Chemical Company of Nashua N. H., and carboxymethyl cellulose (CMC) commercially available from Yixing Tongda Chemical Co. of China.

The aqueous pigment suspension may be applied to the faceplate panel by, for example, spin coating in order to form a color filter layer 60 in the first set of fields 40 of the faceplate panel 12. The spin-coated color filter layer 60 may be heated to a temperature within a range from about 55° C. to about 90° C. to provide increased adhesion of the color filter 60 to the first set of fields 40 of the faceplate panel 12.

Figure 4E:
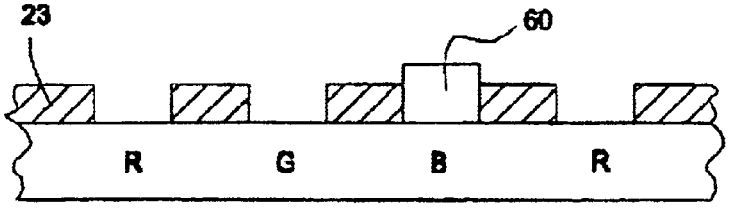

Referring to reference numeral 312 as well as FIG. 4E, the color filter layer 60 is developed by applying an oxidizer thereto. Suitable oxidizers may include for example, periodic acid and hydrogen peroxide, among others. Water may than be applied to the faceplate panel 12 in order to remove the blocking layer 46 as well as the color filter layer 60 over the second set of fields 42 and the third set of fields 44, leaving the color filter 60 remaining in the first set of fields 40.

Figure 4F:
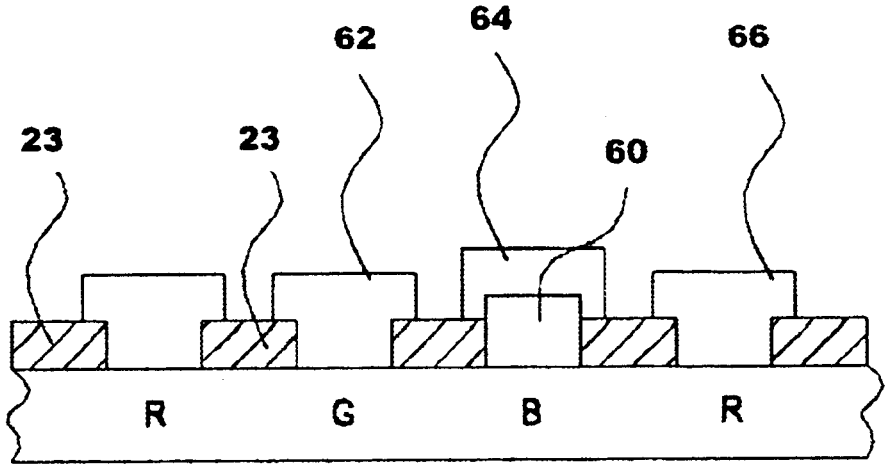

The faceplate panel 12 is then screened with green phosphors 62, non-pigmented blue phosphors 64 and pigmented red phosphors 66, as indicated by reference numeral 314 in FIG. 3 as well as FIG. 4F, preferably, using a screening process in a manner described in U.S. Pat. Nos. 5,370,952, issued Dec. 6, 1994 to Datta et al., 5,554,468 issued Sep. 10, 1996 to Datta et al., 5,807,435 issued Sep. 15, 1998 to Poliniak et al., or 5,474,866 issued Dec. 12, 1995 to Ritt et al.

By way of example, an aqueous pigment suspension was prepared by placing 380 grams of water, 15 grams of a polymeric dispersant DISPEX N-40V (commercially available from Ciba Specialty Chemicals of High Point, N.C.) and 100 grams of TM-3480 Daipyroxide blue pigment (commercially available from Daicolor-Pope, Inc. of Paterson, N.J.) in a ball mill. The aqueous pigment suspension was ball milled using 1/16" zirconium oxide balls for 66 hours to form a pigment concentrate. The average particle size of the pigment concentrate was 122 nanomers (nm) after ball milling. Eighty-one milliliters (ml) of the pigment concentrate was diluted with 37 milliliters of water to form 118 ml of an intermediate pigment suspension comprising 13% pigment. To this intermediate pigment suspension, 5.5 grams of collodial silica, SNOWTEX XS (20% active silica, available from Nissan Chemical Industries of Tokyo, Japan) and 2.5 grams of a 5% Pluronic Series (ethoxypropoxy co-polymer) L-62 solution, commercially available from BASF Corp. of Germany were added. The mixture was stirred for 15 minutes to form the aqueous pigment suspension.

The aqueous pigment suspension was applied to a glass panel such as the faceplate panel 12 described above with reference to FIG. 4D. The panel had a light absorbing matrix layer, similar to the light absorbing matrix 23 as described above with respect to FIG. 4A, as well as a blocking layer similar to the blocking layer 46 formed on the panel as shown in FIG. 4C. The pigment suspension was applied to the faceplate panel at a temperature of about 28° C. and then the coated panel was spun at a speed of 100 rpm for 20 seconds. The faceplate panel was then heated to 65° C. and cooled to 34° C.

The blue filter was developed by re-heating the faceplate panel to 55° C. and applying 450 ml of 0.03% periodic acid thereto. The periodic acid solution was swirled around the panel surface for 2 minutes and then the panel was sprayed with water at 40 psi at 110° F. for 15 seconds to remove the blocking layer and the pigment thereon from the faceplate panel, leaving a blue filter in the first set of fields.

What is claimed is:

1. A method of manufacturing a luminescent screen assembly for a color cathode ray tube (CRT), comprising:

providing a faceplate panel having a patterned light absorbing matrix thereon defining a first set of fields, a second set of fields, and a third set of fields;

applying an aqueous pigment suspension to the first set of fields, wherein the aqueous pigment suspension comprises a pigment, one or more surface active agents, and at least one oxide particle, wherein the at least one oxide particle has a size smaller than the size of the pigment and wherein the at least one oxide particle is present in a concentration of about 5% to about 10% by weight of the pigment.

2. The method of claim 1 wherein the at least one oxide particle comprises a material selected from the group consisting of silica and alumina.

3. The method of claim 1 wherein the pigment is a blue pigment.

4. The method of claim 1 wherein the at least one oxide particle has an average size less than about 50 nanometers.

5. A method of manufacturing a luminescent screen assembly for a color cathode ray tube (CRT), comprising:

providing a faceplate panel having a patterned light absorbing matrix thereon defining a first set of fields, a second set of fields, and a third set of fields;

applying an aqueous pigment suspension to the first set of fields, wherein the aqueous pigment suspension comprises a pigment, one or more surface active agents, and at least one oxide particle, wherein the at least one oxide particle has a size smaller than the size of the pigment, and wherein the pigment is milled for at least 61 hours and wherein the at least one oxide particle is present in a concentration of about 5% to about 10% by weight of the pigment.

6. The method of claim 5 wherein the at least one oxide particle comprises a material selected from the group consisting of silica and alumina.

7. The method of claim 5 wherein the pigment is a blue pigment.

8. The method of claim 5 wherein the at least one oxide particle has an average size less than about 50 nanometers.

* * * * *